US005841060A

United States Patent [19]

Skaggs

[11] Patent Number: 5,841,060

[45] Date of Patent: Nov. 24, 1998

[54] BLAST PLUG

[76] Inventor: Roger Dean Skaggs, 323 Church St., Bonne Terre, Mo. 63664

[21] Appl. No.: 547,582

[22] Filed: Oct. 24, 1995

[51] Int. Cl.[6] ..... F42D 3/00

[52] U.S. Cl. ..... 102/333

[58] Field of Search ..... 102/333

[56] References Cited

U.S. PATENT DOCUMENTS

| | | | |
|---|---|---|---|
| 685,261 | 10/1901 | Crane | 102/333 |
| 921,144 | 5/1909 | McGregor | 102/333 |
| 2,007,568 | 7/1935 | Heitzman | 102/11 |
| 2,115,388 | 4/1938 | Heitzman | 102/11 |
| 2,403,386 | 7/1946 | Lubelsky et al. | 102/333 |
| 2,449,645 | 9/1948 | Du Pont et al. | 102/333 |
| 2,811,839 | 11/1957 | McReynolds, Jr. | 61/35 |
| 3,041,973 | 7/1962 | Sanders | 102/30 |
| 3,126,827 | 3/1964 | McReynolds, Jr. | 102/30 |
| 3,173,368 | 3/1965 | Griffith et al. | 102/30 |
| 3,362,478 | 1/1968 | McReynolds, Jr. | 166/123 |
| 3,366,056 | 1/1968 | Thunell et al. | 102/30 |
| 3,608,491 | 9/1971 | Botes | 102/30 |
| 3,785,291 | 1/1974 | Bergbauer et al. | 102/333 |
| 3,952,656 | 4/1976 | Fox et al. | 102/30 |
| 3,954,058 | 5/1976 | Sanders et al. | 102/30 |
| 4,470,352 | 9/1984 | Leperre | 102/333 |
| 4,660,644 | 4/1987 | Egnor | 102/333 |
| 4,754,705 | 7/1988 | Worsey | 102/333 |
| 5,198,613 | 3/1993 | Jenkins, Jr. | 102/333 |
| 5,247,886 | 9/1993 | Worsey | 102/312 |

*Primary Examiner*—Peter A. Nelson
*Attorney, Agent, or Firm*—Haverstock, Garrett & Roberts

[57] ABSTRACT

A plug device for absorbing the energy of an explosion generated during a blasting operation in a bore located in a rock formation including a cup-shaped member having an annular sidewall and a closure wall, the cup-shaped member being constructed of a yieldable material that allows the cup-shaped member to form a sealed engagement with the bore thereby forming a barrier to the explosive force, the cup-shaped member includes a corrugated construction on the annular sidewall.

9 Claims, 2 Drawing Sheets

BLAST PLUG

The present invention relates to a blast plug device which is used in a bore to prevent energy generated from an explosion from escaping through the bore. The blast plug device may have a cup-shaped construction and be made from an elastic material, with the blast plug device engaging the bore to form a substantially sealed connection between the bore and the blast plug device.

BACKGROUND OF THE INVENTION

Blast plug devices that are placed in a bore to prevent the escape of an explosive force generated from an explosive located in the bore, are well known. The blast plug devices enhance the efficiency of the explosive by preventing the escape of the explosive force and instead focus the explosive force into the earthen material allowing for a more complete fracturing of the earthen material.

The prior art blast plug devices have varying constructions which appear to be different from the present cup-shaped blast plug device. The prior art blast plugs generally have semi-rigid to rigid constructions and are solid, as opposed to the cup-shape of the present device which is flexible and hollow. The prior art rigid constructions generally do not allow the prior art blast plugs to readily yield when placed in a bore and thus prevent the formation of a substantially sealed engagement with the bore. In other words the prior art devices will not stretch and contract, which prevents the formation of a substantially sealed or resilient engagement with the bore. Because a substantially sealed engagement is typically not formed, the gases and repercussion from the explosion can pass along the sides of the plug devices, thereby allowing some of the explosive force to pass through the bore. Thus, a substantially sealed engagement is generally not formed because the prior art blast plugs do not have enough flexibility to maintain a substantially sealed engagement with the bore. Consequently, some of the prior art devices use packing materials or stemming in association with the plug device to prevent the escape of the explosive force. As will be discussed, the use of stemming can be disadvantageous. Thus, the prior art plug devices generally do not contain the explosive force by themselves and instead require the addition of stemming to help contain the explosive force.

Many of the prior art devices, because they are somewhat rigid, are known as dead-lock systems. A dead-lock system forms a rigid barrier in the bore to prevent the passage of the explosive force. The dead-lock system is not elastic and thus does not absorb the explosive force, but is instead a wall that does not permit the passage of the explosive force. Because, the dead-lock system is at least semi-rigid it tends to have very little flexibility or elasticity. The lack of flexibility is a disadvantage because generally it does not allow for the formation of a substantially sealed engagement with the bore. Furthermore, if a dead-lock system moves more than a quarter inch in the bore it will probably be blown out of the bore without containing the explosive force. Thus, many dead-lock systems require the use of stemming in conjunction with the blast plug to prevent the blast plug from being blown out of the bore. Conversely, an elastic device will gradually absorb the explosive force which allows it to more readily contain some of the explosive force and prevents it from being blown out of the bore.

As mentioned, some of the prior art blast plugs suffer from the disadvantage that they require the use of a packing material or stemming. Stemming tends to be loose gravel or rock from a mining operation that is packed into the bore to act as a barrier in conjunction with the blast plug device against the explosive force. The use of stemming can be disadvantageous because it limits the application of the blast plug devices to only certain bores. Because stemming is loose rock or gravel, it is generally difficult to use in a vertical or upward angled bore, as it will slide out of the bore. It may also be disadvantageous in a horizontal bore as it does not always form a sealed or resilient engagement with the wall of the bore. Thus, some prior art blast plug devices have limited applications because they require the use of stemming which prevents their use in certain bores.

Some prior art blast plug devices are designed to be reusable which causes them to be more expensive because of the increased cost associated with recovery. Thus, the expense of some of the reusable plugs can be cost prohibitive to some operations. Also, the reusable blast plug devices can be more expensive to manufacture than disposable blast plug devices which can further be cost prohibitive in some operations. Thus, it is preferred for a blast plug to be disposable as it can be expensive, time consuming, and difficult to recover a reusable blast plug.

Typically, multiple dead-lock blast plugs are used to prevent the escape of the explosive force. As discussed, the dead-lock blast plugs generally are not flexible. The lack of flexibility does not permit the dead-lock blast plugs to gradually release from the bore, nor does it permit the formation of air pressure chambers between the plugs. The flexibility of the present blast plugs allows them to form air pressure chambers which helps to contain the explosive force. The formation of an air pressure chamber is advantageous because fewer plug members have to be used and there is greater resistance to the explosive force.

The construction of some of the prior art blast plugs makes it difficult to properly place the blast plugs in the bore so as to properly receive the explosive force. Thus, because of the construction of some of the prior art blast plug devices they may shift when placed in the bore which will prevent them from effectively stopping an explosive force. If the blast plug devices are not properly placed in the bore they will not effectively prevent the escape of the explosive force because they will not properly receive the explosive force. The present device is advantageous because it is easily placed into a proper position for receiving the explosive force, in part because of its flexibility.

SUMMARY OF THE INVENTION

The present invention resides in a blast plug device which may be placed in a bore that has been drilled into a rock formation or any other earthen material and minimizes the loss of the effect of the explosion, which otherwise would be reduced to the extent that the force would flow back through the bore. In its preferred form, the present device includes a cup-shaped member made of a relatively elastic, yieldable material. The cup-shaped blast plug has an annular sidewall portion which may have one or more outwardly extending annular rib portions extending therearound and is closed at one end by an end wall. The shape of the present cup-shaped member allows it to be easily placed into a bore which has a smaller diameter than the unstressed diameter of the cup-shaped member. The cup-shaped member can be pushed into the bore using a rod or like member, including a rod member that has linear dimensions on it like a ruler so that the person pushing the cup-shaped member into the bore will force the wall of the cup-shaped member to sealably engage the wall of the bore. The annular sidewall of the cup-shaped member may have one or more annular ribs separated by annular grooves. The elasticity of the subject cup-shaped member is advantageous to the effectiveness of the subject blast plug since it engages the wall in a resilient manner and provides one or more corrugations which allow the blast plug to absorb some of the explosive energy, thereby increasing the effectiveness of the subject blast plug in preventing the gases generated during the explosion from escaping through the bore. It is also possible to use several blast plugs in the same bore, with one operating independently of the other to take some of the shock that occurs during the explosion. The fact that the subject blast plug resiliently and sealably engages the bore is important because known blast plugs are formed of hard materials which do not allow the known blast plugs to conform to and grip the bore. Also since the subject blast plugs are relatively inexpensive to make and are easy to use they are very useful to people who need such devices in the field. This is an advantage because it means that once a blast plug has been used, no effort needs to be made to recover the plug and reuse it.

The end wall of the subject cup-shaped member may be a flat wall with an opening through it to accommodate the electrical connection between the explosive material and the mechanism that is operated to produce the blast. With the present device the electrical cord can be strung through one or more blast plugs, and the blasts plugs can be installed using the same or similar rods to push them into place. The annular surface of the cup-shaped member may also include axial indentations or corrugations located at circumferentially spaced locations therearound. Each cup-shaped member allows the subject member to collapse on itself thereby engaging the adjacent spaced corrugations which operate together to resist the escape of the explosion through the bore.

The end wall of the surface may be a flat wall member with an opening or hole for the wire or it may be nipple-shaped which has advantages in some constructions including absorbing some of the shock of the explosion even before the forces of the explosion have moved the end wall into the cup-shaped member.

It has been found in practice that positioning more than one cup-shaped member in the same bore may further reduce the amount of force that escapes back through the bore and therefore more effectively stops the explosive forces or prevents the explosive forces from losing part of their effectiveness. The use of several cup-shaped members in the same bore has been found to substantially reduce the loss of force through the bore during an explosion. Also, by having more than one blast plug in the same bore, the blast plug closest to the explosive can move relative to the end wall of the second, third and fourth blast plugs in the same bore, thereby creating air chambers between the spaced end walls that help to further reduce the amount of force that is lost in an explosion by passing through the bore. The air between the adjacent end walls of the spaced blast plugs is sometimes referred to as forming an air pressure chamber and such chambers may be very helpful to confine an explosion and to increase the effectiveness of the explosion in the surrounding ground. The present blast plugs can be used in association with a stemming or granular fill, however, such fills are not usually needed and are unnecessary when using the present construction. Thus, it can be seen that the subject cup-shaped blast plugs have many advantages over known blast plugs including reusable blast plugs and blast plugs that are formed out of a relatively rigid non-yieldable or non-elastic material. Also the inexpensiveness of the present blast plug makes it generally unnecessary to try to reenter a bore in order to recover a blast plug for later use. Thus, the present invention provides a novel means for reducing the amount of pressure and force produced during an explosion from escaping, and particularly, an explosion where it is desirable to concentrate the forces of the explosion in parts of the ground which are intended to be pulverized during the explosion.

OBJECTS OF THE INVENTION

A principle object of the present invention is to provide relatively inexpensive, easy to install and generally non-reusable blast plug which can be easily inserted into a bore to absorb as much as possible of the energy of an explosion thereby preventing the force produced by the blast from being wasted.

Another object of the present invention is to provide a blast plug that is flexible and resiliently and preferably sealably engages the bore in which it is pushed to minimize the wasting of the forces of an explosion, when the explosive is detonated.

Another object is to teach the construction of a blast plug that can be installed in a bore that is drilled into the ground or any other surface regardless of the direction or orientation of the bore.

Another object is to provide a blast plug that does not require the use of other materials to fill the bore, such as stemming and granular materials.

These and other objects and advantages of the present invention will become apparent after considering the following detailed specification covering preferred embodiments in conjunction with the accompanying drawings.

DESCRIPTION OF THE PREFERRED EMBODIMENT

Figure 1:
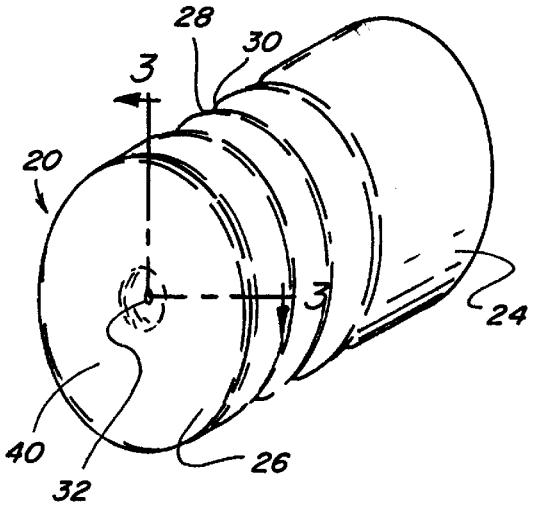
FIG. 1 is a perspective view of a cup-shaped blast plug member.

Referring to the drawings more particularly by reference numbers, number 20 in FIG. 1 refers to a blast plug for absorbing energy generated during a blasting operation in a bore 22. The blast plug 20 not only absorbs energy from a blast, but prevents the energy from passing through the bore 22, with the blast plug shown in its functional position in FIG. 2. The blast plug 20 shown in FIG. 1 is one of the preferred constructions and is a cup-shaped plug member having an annular sidewall 24 closed at one end by a closure wall 26. The cup-shaped plug member 20 is made from a yieldable material and is placed into a bore 22 having a smaller diameter than the cup-shaped plug member. Preferably, the outside diameter of the cup-shaped plug member 20 is somewhat greater than the diameter of the bore 22 so that the cup-shaped plug member must yield or stretch when placed in the bore to form a substantially sealed engagement. The cup-shaped plug member 20 is placed into the bore 22 by using a rod 21 or similar device, which may have linear dimensions similar to a ruler so that a user may place the cup-shaped plug member in a desired position or depth in the bore. As the cup-shaped plug member 20 is pushed into the bore 22 it yields so that it easily slides into the bore while forming a resilient or substantially sealed engagement with the bore. The cup-shaped plug member 20 will have at least one annular ridge 28 and at least one annular groove 30, which form a corrugated construction, as shown in FIGS. 1, 2, 3, 4, and 5. The corrugated construction is advantageous because it allows the cup-shaped plug member 20 to expand and contract so as to readily conform to the diameter of the bore 22 and to maintain a substantially sealed engagement with the bore.

Figure 2:
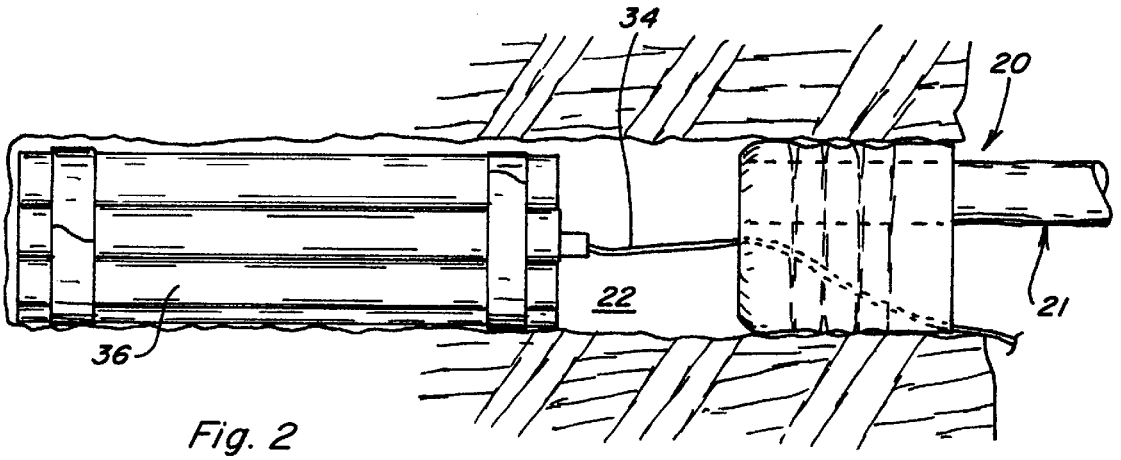
FIG. 2 is a side view of the cup-shaped blast plug member in a functional arrangement with an explosive located in a bore.

Preferably, the cup-shaped plug member 20 will have a hole or similar means 32 located in the closure wall 26 to allow a wire or detonation cord 34 to pass through the cup-shaped plug member, as shown in FIG. 2. The wire 34 that passes through the cup-shaped plug member 20 links an explosive 36 to a detonation device. Thus, in the preferred embodiment the wire 34 is strung through the cup-shaped plug member 20 and the cup-shaped plug member is then pushed into the bore 22 with a rod 21, with the cup-shaped plug member resiliently engaging the bore. Once the cup-shaped plug member is in the bore, it will prevent an explosive force from passing back through the bore. Also, the cup-shaped plug member may be placed in bores of any angle including horizontal bores, vertical bores, and other angled bores.

Figure 3:
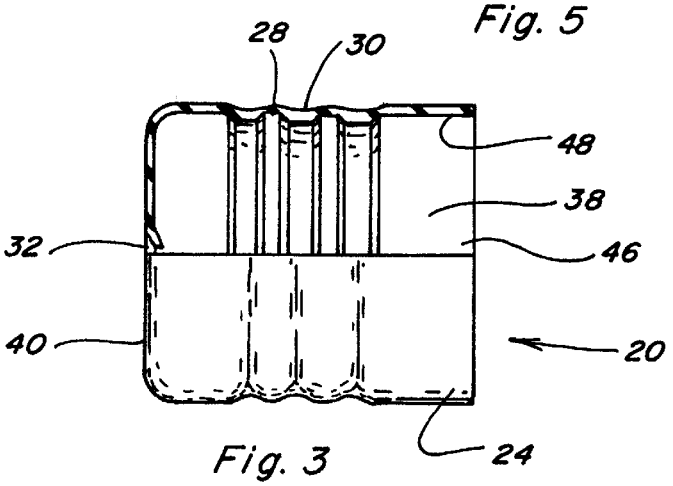
FIG. 3 is a side cut away view of the cup-shaped blast plug member showing its annular ribs and grooves.

When an explosion occurs the closure wall 26 of the cup-shaped plug member 20 will receive the explosive force, with the explosive force causing the closure wall to be pushed into a hollow portion 38 located on the inside of the cup-shaped plug member, as shown in FIG. 3. Furthermore, it is believed that the corrugated construction helps the cup-shaped plug member 20 absorb the explosive force by allowing for greater deformation of the cup-shaped member as it reverses itself through the inside of the annular sidewall and thus more energy absorption occurs. The explosive energy, instead of escaping, is refocused into the surrounding earthen material or rock to allow for a more complete fracturing of the earthen material. In a preferred use, multiple cup-shaped plug members may be used to more effectively prevent the escape of the explosive force. The multiple cup-shaped plug members work by forming an air pressure chamber between the plug receiving the blast and other cup-shaped plugs outwardly of the plug receiving the blast. The air pressure chambers allow the multiple cup-shaped plug members to provide a stronger barrier than a singular cup-shaped plug member.

The cup-shaped plug member 20 may be made from any of a variety of materials, with any flexible, elastic material that can withstand being placed in a bore being acceptable. Preferably, however, a flexible plastic is used that allows the cup-shaped plug member to be yieldable so as to readily engage the bore 22. As can be seen in FIG. 2, the yieldable cup-shaped plug member 20 forms a substantially sealed or a resilient engagement with the bore 22, and is held in place by frictional engagement between the wall of the bore and the cup-shaped plug member. Because the cup-shaped plug member 20 is preferably made from a yieldable plastic it is easy to push the plug member into the bore and to properly position the plug to receive the explosive force. Thus, the cup-shaped plug member 20 engages the bore 22 to form a sealed or resilient connection that substantially prevents the escape of the explosive force.

The cup-shaped plug member 20 may have an outside diameter ranging from between about 1 inch to about 18 inches, and a length ranging between about 2 inches and about 36 inches, with the desired diameter and length of the cup-shaped plug member dependent on the diameter of the bore 22. It is preferred, however, for the cup-shaped plug member 20 to have an outside diameter that is slightly larger than the diameter of the bore 22, so that a substantially sealed engagement can be formed between the cup-shaped plug member and the bore. The outside diameter of the cup-shaped plug member may range from about a sixteenth of an inch larger than the bore to about one half of an inch larger than the bore, with the preferred diameter being about a quarter of an inch larger than the bore. Further, the annular sidewall 24 and closure wall 26 generally have the same thickness, with the thickness ranging from between about 50 thousandths to about 100 thousandths of an inch.

In a preferred construction, the cup-shaped plug member 20 has at least one outwardly extending annular rib 28 located on the sidewall 24, as shown in FIGS. 1, 2, 3, 4, and 5. The diameter of the annular rib 28 may vary with the construction of the cup-shaped plug member 20. On one or both sides of each annular rib 28 is an annular groove 30, which has an outside diameter that is smaller than the diameter of the adjacent ribs or corrugations, with the annular groove projecting inward. The annular grooves 30 protrude inwardly so that the annular grooves have an outside diameter between about one half inch and an outside diameter slightly less than the diameter of the annular ribs. Preferably, there are a plurality of annular ribs and a plurality of annular grooves located on the sidewall 24. The ribs and grooves in effect form a corrugated construction, as shown in FIGS. 1, 2, 3, 4, and 5.

The grooves 30 and the ribs 28 cause the cup-shaped plug member 20 to be somewhat pliable which allows for an accordion effect when the cup-shaped plug member is pushed into a bore 22. The pliability of the cup-shaped plug member 20 allows it to stretch and contract to more readily adjust to the diameter of the bore. Because the diameter of the bore 22 may vary, it is advantageous for the cup-shaped plug member 20 to stretch and contract, while maintaining engagement with the bore 22. Thus, the cup-shaped plug member 20 may be placed in a bore 22 having a variable diameter and still maintain a sealed engagement therewith. The elasticity of the cup-shaped plug member also allows the cup-shaped plug member to be properly positioned so that the closure wall can receive the explosive force. The ribs 28 and grooves 30 are advantageous as they allow the cup-shaped plug member 20 to be more elastic and thus allow easy placement in the bore 22. Thus, the annular ribs 28 in conjunction with the annular grooves 30 allow the cup-shaped plug member 20 to more readily grip the bore 22 and form a substantially sealed or resilient engagement, between the bore and the annular sidewall 24.

Figure 5:
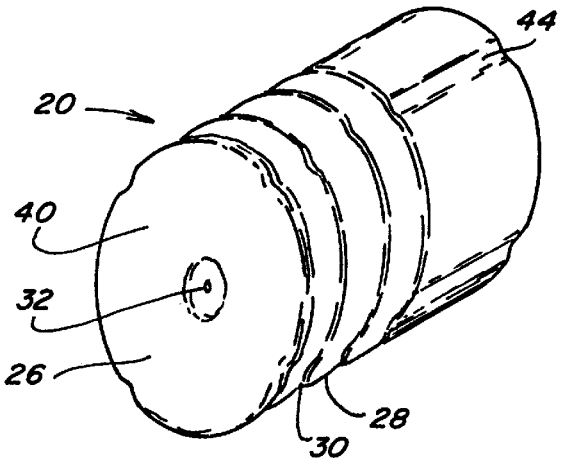
FIG. 5 is a perspective view of the cup-shaped blast plug member having axial indentations formed in the sidewall.
Figure 4:
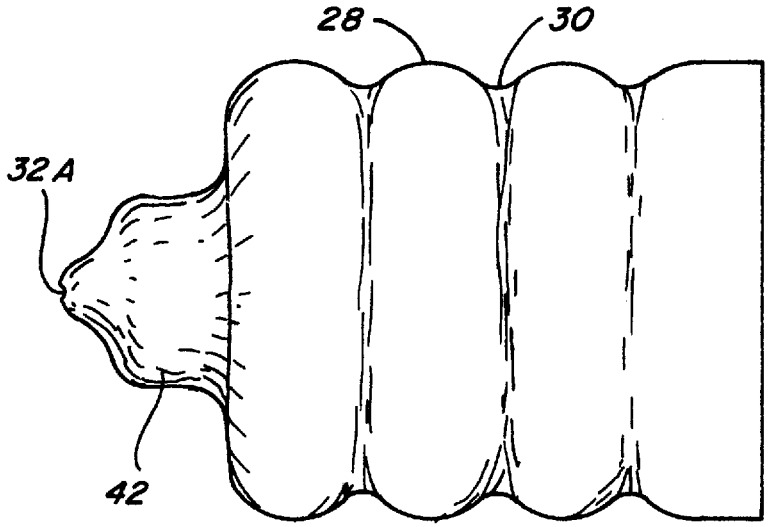
FIG. 4 is a side view of a cup-shaped blast plug member having a nipple-shaped closure wall.
Figure 7:
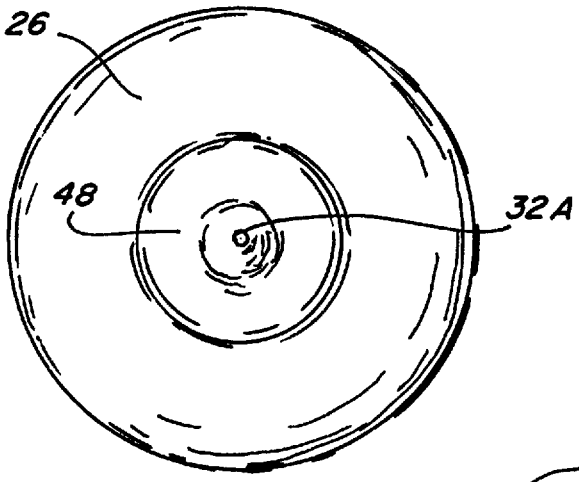
FIG. 7 is a front end view the nipple-shaped closure wall of the cup-shaped member.
Figure 6:
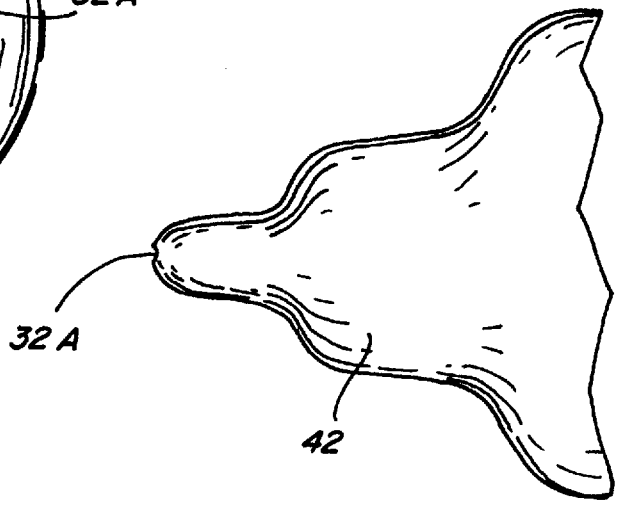
FIG. 6 is an enlarged cross-sectional view of a nipple-shaped closure wall for the cup-shaped blast plug member.

The closure wall 26 may have different constructions, with two of the constructions being a substantially planar closure wall 40, shown in FIGS. 1, 3, and 5, and a nipple-shaped closure wall 42, shown in FIGS. 4, 6, and 7. The nipple-shaped closure wall 42 has advantages in some applications. The nipple-shaped construction 42 imparts more potential force resistance because it allows the closure wall 42 to reverse itself and stretch through the interior portion 38 of the annular sidewall 24 for a greater distance before tearing, as compared to other closure wall constructions. In other words the nipple-shaped closure wall 42 remains in tact longer and is thus a potentially more resistant barrier. The substantially planar closure wall 40 also readily resists the explosive force and adequately contains the explosive force within the bore 22. The nipple shaped closure wall 42 preferably has the hole 32A located in the tip of the nipple portion. As can be seen in FIGS. 4 and 6 the nipple shaped closure wall 42 may have differing constructions.

As stated, it is preferred for the cup-shaped plug member 20 to have a hole or similar means 32 or 32A which allows a wire 34 to pass through the cup-shaped plug member. The hole 32 and 32A allows an electrical connection or wire 34 from the explosive material 36 to pass through the cup-shaped plug member 20 to a device for detonating the explosive material. Typically, the passage 32 and 32A is a hole, as shown in FIGS. 1, 3, 5, and 7, however, in the alternative a space can be cut or formed in the sidewall 24 to allow passage of the wire 34 along the side of the cup-shaped plug member 20. Preferably, however, the cup-shaped plug member 20 has a hole 32 or 32A located in the closure wall 26, with the hole generally near the center. The hole 32 or 32A in the closure wall 26 is advantageous as it allows the wire 34 to pass through the center of the cup-shaped plug member 20, which facilitates the formation of a substantially sealed resilient connection between the bore 22 and the cup-shaped plug member. If the detonation cord 34 is passed along the side of the cup-shaped plug member 20 there is potential for the cord to be cut by the cup-shaped plug member as it is pushed into the bore.

In another embodiment of the cup-shaped plug member 20 shown in FIG. 5, at least one axial indentation 44 protrudes inwardly and is located in the annular sidewall 24. Generally, when used, a plurality of such axial indentations 44 are present on the cup-shaped plug member 20. Typically, the axial indentations 44 extend from the open end 46 of the sidewall 24 to the closure wall 26, however, other lengths may be used.

The cup-shaped plug member 20 may be made from any flexible elastic material. Preferably an elastic plastic is used such as a thermoplastic. The thermoplastic may be a polyvinyl chloride, a polyethylene, a polystyrene, or a polyurethane, as well as any other acceptable thermoplastic. Any material, however, may be used that is flexible and can be formed into a cup-shaped plug member. Also, the material must not readily tear when being placed in the bore.

As stated, it is preferred to use multiple cup-shaped plug members 20 together in the bore 22, as multiple plugs increase the resistance to the explosive force, thus preventing more of the explosive force from escaping through the bore. The multiple cup-shaped plug members 20 are placed into the bore 22 the same as a singular cup-shaped plug member, with each cup-shaped plug member being pushed into the bore by a rod or similar device. Also, each cup-shaped plug member 20 will have the wire 34 preferably threaded through the passage 32. The use of multiple cup-shaped plug members is particularly advantageous as the multiple plugs work in tandem to form a force resistive air pressure chamber. The air pressure chamber is formed when the first cup-shaped plug member receives the explosive blast, which causes the closure wall 26 of the first cup-shaped plug member to move towards the second outwardly placed cup-shaped plug member. The movement of the closure wall 26 compresses the air between the first cup-shaped plug member and the second cup-shaped plug member. The compressed air between the cup-shaped plug members forms the air pressure chamber which increases the resistance to force, as the air chamber is basically a barrier that does not allow the passage of the explosive force. When more than two cup-shaped plug members are used an air chamber is formed between each plug as previously described. The use of multiple cup-shaped blast plugs is advantageous as more of the explosive force is focused into the earthen material, which causes greater fracturing or breaking of the earthen material. Typically, as more blast plugs are placed in the bore the force retention capabilities increase. Thus, it is advantageous to use multiple cup-shaped plug members to contain the explosive energy.

The cup-shaped blast plug 20 may also be used with granule fill or stemming, which can be any type of packing material, but tends to be loose rock or gravel. When in use the cup-shaped plug member 20 is placed into a bore 22 and the stemming is then placed into the bore after the cup-shaped plug member, so that the stemming is located on the interior or hollow portion 38 of the cup-shaped plug member and also fills part of the bore away from the plug. When the cup-shaped plug member 20 receives the blast the closure wall 26 will attempt to pass through the hollow portion 38 of the annular sidewall 24, forcing the stemming outward towards the interior portion 48 of the annular sidewall. By forcing the stemming outward, the cup-shaped plug member 20 forms an even tighter engagement with the bore 22 which allows the cup-shaped plug member to become a more solid barrier. Thus, the explosive force causes the granule material to compress into the cup-shaped plug member 20 thereby forming a highly resistive barrier.

In an alternative embodiment, the passage 32 is not included in the construction allowing the blast plug 20 to be used as a device for preventing debris from entering the bore 22.

Thus, there has been shown and described several embodiments of a blast plug device which satisfy all of the objects and advantages set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow:

What is claimed:

1. Plug means to absorb some of the energy of an explosion generated during a blasting operation where an explosive is positioned in a bore drilled into a rock formation, said plug means comprising a cup-shaped member formed of a relatively yieldable plastic material including an annular sidewall closed at one end by a closure wall, whereby said sidewall has at least one annular outwardly extending rib portion and at least one inwardly extending annular groove, the diameter of said cup shaped member substantially conforming to the diameter of the bore drilled into the rock formation with said cup shaped member having an unstressed diameter larger than the bore, said cup shaped member being movable into the bore such that said annular sidewall including said rib yieldably engages the wall of the bore to form a substantially sealed connection between the bore and said cup-shaped member, said cup shaped member acting as a barrier against the forces of an explosion coming through the bore.

2. The plug means of claim 1 wherein said closure wall has a passage therethrough to accommodate a wire from the explosive to a detonation device.

3. The plug means of claim 1 wherein said closure wall is substantially planar.

4. The plug means of claim 1 wherein said closure wall is nipple-shaped.

5. The plug means of claim 1 wherein said sidewall has at least one axial inward extending indentation formed along the length of said sidewall.

6. The plug means of claim 1 wherein said cup-shaped member has an outside diameter slightly larger than the diameter of the bore.

7. Plug means to absorb some of the energy generated during a blasting operation wherein an explosive is positioned in a bore drilled into a rock formation, said plug means including a cup-shaped member formed of a relatively elastic material including an annular sidewall closed at one end by a closure wall, said sidewall having at least one annular corrugation including an outwardly extending ridge and adjacent inwardly extending valleys, the unstressed diameter of said corrugation exceeding the diameter of the bore into which it is positioned, said cup-shaped member having a passage therethrough to accommodate a wire extending from the explosive to a detonation device.

8. Plug means to absorb some of the energy of an explosion generated during a blasting operation where an explosive is positioned in a bore drilled into a rock formation, said plug means comprised of a cup-shaped member formed of an elastic material including an annular sidewall closed at one end by a closure wall whereby said sidewall has a plurality of annular outwardly extending rib portions and a plurality of inwardly extending annular groove portions, the unstressed diameter of said rib portions exceeding the diameter of the bore drilled into the rock formation, said cup-shaped member being movable into the bore such that said annular ribs yieldably engage the wall of the bore to form a resilient connection between the bore and said cup-shaped member, said closure wall having a passage therethrough to accommodate a wire.

9. Plug means to absorb some of the energy of an explosion generated during a blasting operation where an explosive is positioned in a bore drilled into the earth, said plug means comprised of a cup-shaped member formed of a yieldable material, with said cup shaped member having an unstressed diameter larger than the diameter of the bore.

* * * * *